US010024329B2

(12) United States Patent
Fetting et al.

(10) Patent No.: US 10,024,329 B2
(45) Date of Patent: Jul. 17, 2018

(54) FAN ASSEMBLY

(71) Applicant: Greenheck Fan Corporation, Schofield, WI (US)

(72) Inventors: Nathan D. Fetting, Wausau, WI (US); Scott S. Kurszewski, Wittenberg, WI (US); Joe A. Knoedler, Mosinee, WI (US); Todd J. Burns, Kronenwetter, WI (US)

(73) Assignee: Greenheck Fan Corporation, Schofield, WI (US)

( * ) Notice: Subject to any disclaimer, the term of this patent is extended or adjusted under 35 U.S.C. 154(b) by 1115 days.

(21) Appl. No.: 14/140,164

(22) Filed: Dec. 24, 2013

(65) Prior Publication Data

US 2015/0176603 A1 Jun. 25, 2015

(51) Int. Cl.

| | |
|---|---|
| ***F04D 29/64*** | (2006.01) |
| ***F04D 19/00*** | (2006.01) |
| ***F04D 29/54*** | (2006.01) |
| ***F04D 25/06*** | (2006.01) |
| ***F04D 29/02*** | (2006.01) |
| ***F04D 29/42*** | (2006.01) |
| ***F04D 29/62*** | (2006.01) |

(52) U.S. Cl.

CPC ..... *F04D 25/0606* (2013.01); *F04D 29/023* (2013.01); *F04D 29/4253* (2013.01); *F04D 29/626* (2013.01); *F04D 29/542* (2013.01); *F05D 2230/23* (2013.01); *F05D 2230/54* (2013.01)

(58) Field of Classification Search

CPC .... F04D 29/40; F04D 29/403; F04D 29/4206; F04D 29/4226; F04D 29/4253; F04D 29/325; F04D 29/522; F04D 19/002; F04D 17/165; F04D 29/545; F04D 29/547; F04D 25/24; F04D 25/243; F04D 25/246; F04D 25/26; F04D 25/265

See application file for complete search history.

(56) References Cited

U.S. PATENT DOCUMENTS

| | | | | |
|---|---|---|---|---|
| 3,412,929 | A * | 11/1968 | Greenheck | F04D 17/165 415/126 |
| 3,811,790 | A | 5/1974 | Mikulina et al. | |
| 3,924,963 | A * | 12/1975 | Zerrer | F04D 17/02 415/126 |
| 4,092,088 | A * | 5/1978 | Nemesi | F04D 29/626 415/201 |
| 4,913,621 | A | 4/1990 | Reither | |
| 8,151,931 | B2 | 4/2012 | Eaton et al. | |
| 2013/0051999 | A1 | 2/2013 | Wenger et al. | |

* cited by examiner

*Primary Examiner* — Kenneth Bomberg
*Assistant Examiner* — Julian Getachew
(74) *Attorney, Agent, or Firm* — Merchant & Gould P.C.

(57) ABSTRACT

A fan assembly in which all of the major structural components of the assembly are mechanically fastened together by non-welding means, such as mechanical fasteners, is disclosed. The disclosure also relates to a fan assembly in which the major structural components have planar segments separated by bend lines that approximate a curved shape, and that can be formed, for example, by a press brake machine. Such a construction can eliminate the necessity for rolling, welding, and painting of the structural components of the fan assembly.

20 Claims, 13 Drawing Sheets

FAN ASSEMBLY

TECHNICAL FIELD

This disclosure relates to fan assemblies for providing an airflow stream, and particularly to in-line fan assemblies configured to provide an axial airflow through an outer chamber.

BACKGROUND

Fan assemblies for providing an airflow stream are known. One type of fan assembly is an in-line fan assembly including a housing containing a fan rotor for moving an airflow stream through the housing. Many in-line fan assembly housings are cylindrical in shape which requires specialized manufacturing equipment and processes in addition to limiting the types of materials that can be used. For example, in order to construct a traditional cylindrical fan housing, several pieces of equipment are required including: a roller, a seam welder, and a flanger. Secondary components that require connection to the main structure (i.e. motor plate, bearing plate, turning vanes, etc.) can also require welding. Due to the significant welding amounts, tubular designs are traditionally constructed from hot-rolled steel, thereby additionally requiring paint. Other higher strength materials, such as stainless steel, are not as frequently used due to the difficulty of manufacturing tubes and curved shapes from such materials. Accordingly, improvements in fan assemblies are desired.

SUMMARY

This disclosure relates to a fan assembly in which none of the major structural components of the assembly are fastened together by welding and are instead mechanically fastened together. Because the major structural components are not fastened together by welding, painting of the components can be avoided. The disclosure also relates to a fan assembly in which none of the major structural components has a curved shape formed by a rolling process. Instead, curved shapes of the major structural components are approximated by planar segments separated by bend lines that can be formed, for example, by a press brake machine.

In one aspect, the fan assembly has an outer chamber and a rotatable fan assembly disposed within the outer chamber. The outer chamber can define a longitudinal axis extending between a first open end and an opposite second open end. As configured, the rotatable fan assembly moves an airflow stream through the outer chamber from the first open end towards the second open end.

In one aspect, the outer chamber has at least five planar sidewall segments that together form a tubular structure having a polygonal cross-sectional shape. In one embodiment, the outer chamber is formed by a first section and a second section that are connected to each other by mechanical fasteners. The first and second open ends can be provided with flanges to which adapter rings can be connected. Where the rotatable fan assembly includes a mixed-flow type fan rotor, an inlet cone may be installed at the first open end of the chamber adjacent the adapter ring.

The fan assembly may also include an inner chamber having a plurality of planar sidewall segments that together form a tubular structure with a cross-sectional polygonal shape, wherein the inner chamber is disposed within the outer chamber and defines a longitudinal axis extending between a first open end and an opposite second open end.

The first open end of the inner chamber may be mechanically secured to an end plate to prevent the airflow stream from passing through the inner chamber thereby ensuring that the airflow stream passes in the interstitial area between the inner and outer chambers.

A tail cone assembly may be provided that is mechanically fastened to the second open end of the inner chamber. In one embodiment, the tail cone assembly has at least five planar sidewall segments that together form a tapered tubular structure with a generally polygonal cross-sectional shape with a first open end and a second open end. The tail cone assembly may also have first and second sections that are mechanically fastened to each other and an end plate secured to one of the first and second open ends.

A plurality of turning vanes may also be provided in the fan assembly. The turning vanes function to straighten airflow leaving the rotatable fan assembly and also structurally secure the inner chamber to the outer chamber. As configured, the turning vanes extend from the outer chamber and towards the inner chamber. In one embodiment, each turning vane has a main body with a plurality of planar segments separated by bend lines. The turning vanes may also be provided with tabs or other structures such that they can be mechanically fastened to the inner and/or outer chambers.

The fan assembly may also be provided with a motor assembly including a motor plate, a motor cover, and a motor seal, each of which can be mechanically fastened to the outer chamber. Mounting legs may also be provided for the fan assembly and mechanically fastened to the outer chamber. A bearing plate may also be provided within the inner chamber that is configured to support the rotatable fan assembly and to secure the inner chamber to the outer chamber. In one embodiment, the bearing plate may be mechanically fastened to the inner chamber and to the outer chamber.

BRIEF DESCRIPTION OF THE DRAWINGS

Non-limiting and non-exhaustive embodiments are described with reference to the following figures, which are not necessarily drawn to scale, wherein like reference numerals refer to like parts throughout the various views unless otherwise specified.

DETAILED DESCRIPTION

Figure 1:
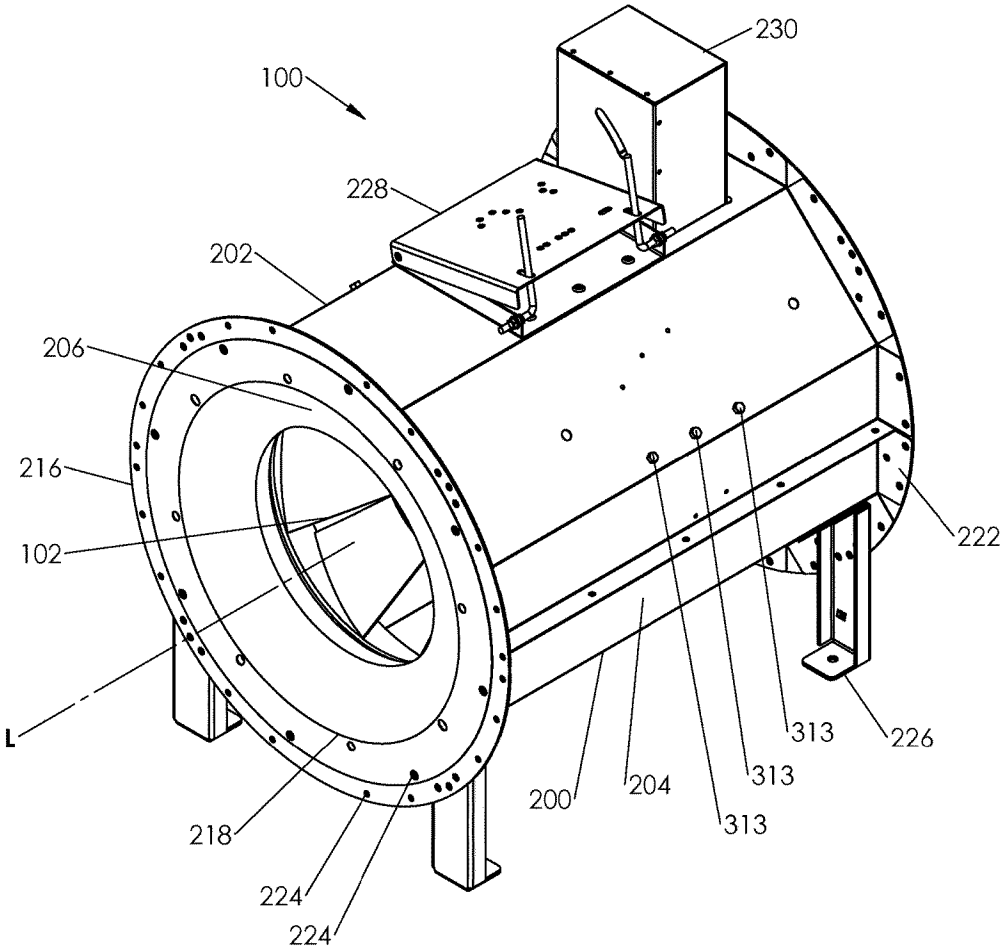
FIG. 1 is a front perspective view of a first embodiment of a fan assembly having features that are examples of aspects in accordance with the principles of the present disclosure.
Figure 2:
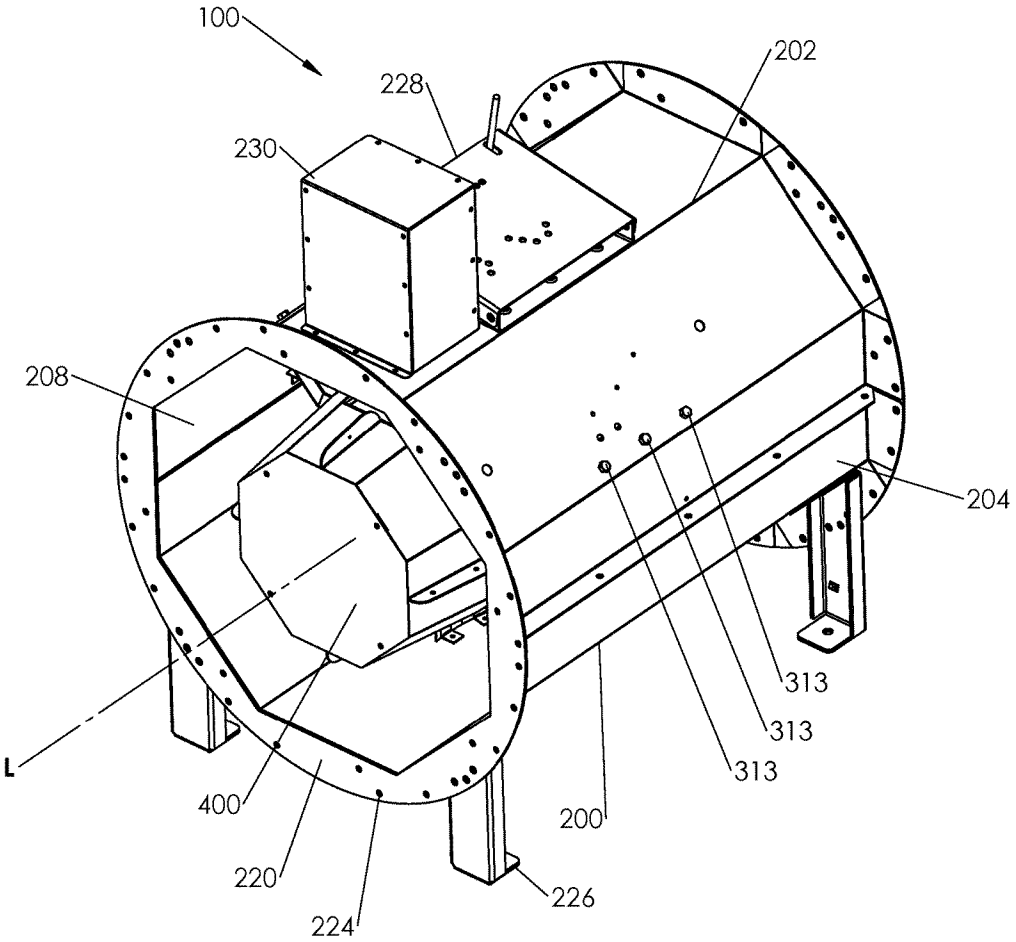
FIG. 2 is a rear perspective view of the fan assembly shown in FIG. 1.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

Referring now to FIG. 1, an example fan assembly 100 is shown. Fan assembly 100 is for providing means for transporting air, such as through a ducting system (not shown) relating to a building heating, ventilation, air conditioning, recirculation, and/or exhaust air system. As shown, fan assembly 100 is constructed such that the major structural components of the fan assembly 100 have a segmented shape that can be secured together without welding. By use of the term "major structural components" it is intended to include the outer chamber 200, the inner chamber 100, and the bearing plate 312 of the fan assembly 100, each of which will be discussed in greater detail herein. In embodiments where the turning vanes 500 secure the inner chamber 100 to the outer chamber 200, the turning vanes 500 can also be considered a major structural component. In the embodiment shown, fan assembly 100 is a mixed-flow type fan assembly having a mixed-flow type fan rotor 102 supported by a shaft 104 that is driven by a belt 108 connected to an electric motor 106. Alternatively, the fan rotor can be another type of fan rotor such as an axial fan rotor. Also, the shaft 104 can be configured to be directly driven by the electric motor 106 instead of indirectly driven by the belt 108.

By use of the term "segmented shape" it is meant to include those shapes that are formed by planar surfaces or segments separated by bend lines that approximate a curve in contrast to shapes that are formed with a continuously curved surface. One example of a segmented shape is a generally polygonal shape. By use of the terms "mechanical fastener", "mechanically fastened", and "non-welded means" it is intended to include any method of attachment between two components other than welding. Non-limiting examples of mechanical fasteners are bolts, screws, rivets, clips, and latches.

Fan assembly 100 includes an outer chamber 200 configured for housing a number of components, for example a fan rotor 102. As shown, outer chamber 200 includes a first section 202 and a second section 204 that cooperatively form a tubular structure having a generally polygonal cross-sectional shape extending between a first open end 206 and a second open end 208, and defining a longitudinal axis L. Although the outer chamber 200 is shown as having a generally octagonal shape with 8 planar sections, other generally polygonal shapes are possible, such as pentagonal (five sides), hexagonal (six sides), heptagonal (seven sides), decagonal (ten sides), and dodecagonal (twelve sides) shapes which progressively define cross-sectional shapes that approximate a circle. Additionally, although outer chamber 200 is shown as having two sections 202, 204, more sections may be provided.

Figure 7:
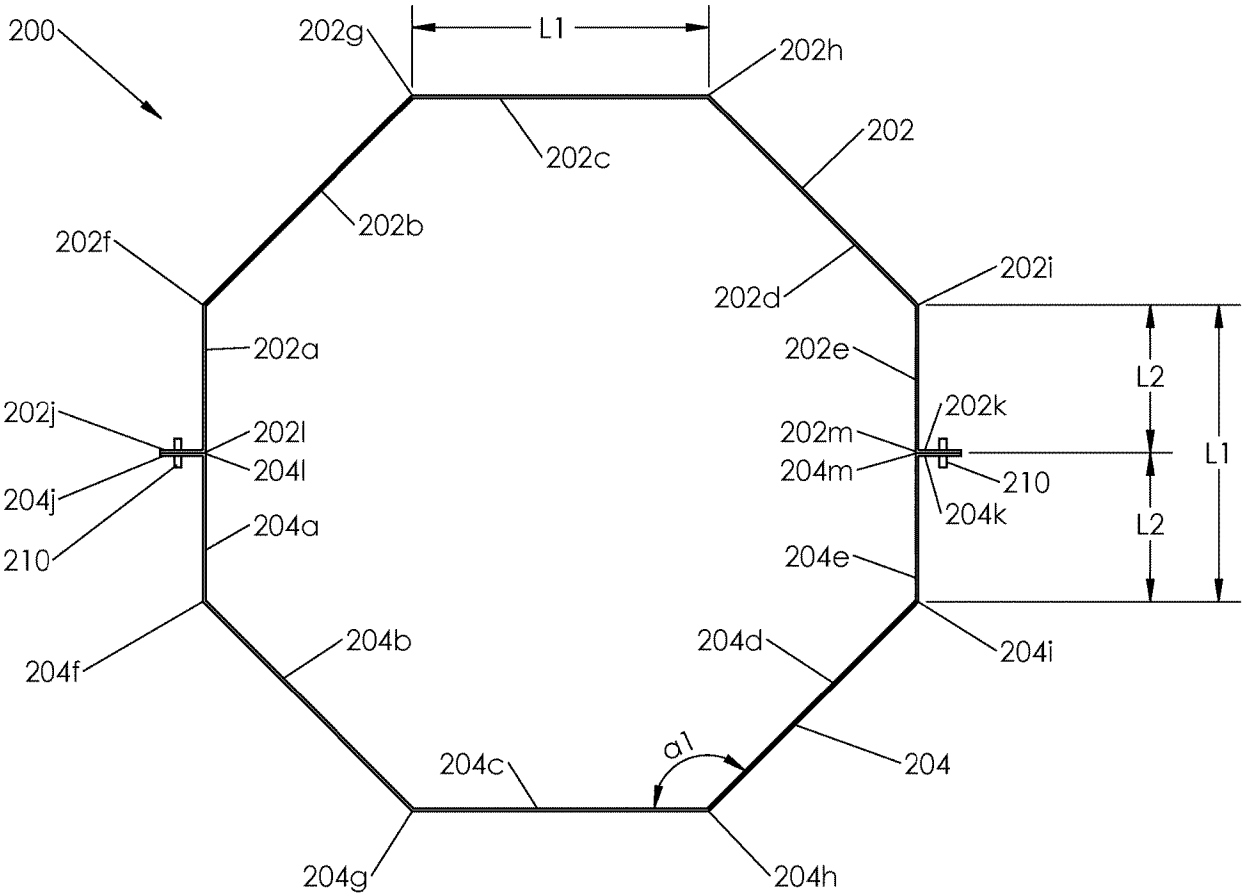
FIG. 7 is a cross-sectional view of an outer chamber of the fan assembly shown in FIG. 1.

In the embodiment presented in the drawings, and as most easily seen in the schematic representation shown at FIG. 7, each of the first and second sections 202, 204 is provided with five planar sections separated by bend lines that together form a generally octagonal cross-sectional shape. In particular, the outer chamber first section 202 is provided with planar sections 202*a*, 202*b*, 202*c*, 202*d*, 202*e* (collectively referred to as 202*a-e*) separated by bend lines 202*f*, 202*g*, 202*h*, and 202*i* (collectively referred to as 202*f-i*). Similarly, the outer chamber second section 204 is provided with planar sections 204*a*, 204*b*, 204*c*, 204*d*, 204*e* (collectively referred to as 204*a-e*) separated by bend lines 204*f*, 204*g*, 204*h*, and 204*i* (collectively referred to as 204*f-i*). As shown, planar sections 202*b-d* and 204*b-d* each have a length L1 while planar sections 202*a*, 202*e*, 204*a*, and 204*e* each have a length L2 that is about one half the length of L1. This construction allows for planar sections 202*a* and 204*a* to form one of the full sides of the outer chamber 202 and for planar sections 202*e* and 204*e* to cooperatively form another one of the full sides of the outer chamber 202. It is noted that sections 202*a*/202*a* and 202*e*/204*e* do not have to have the same length as each other as long as their combined lengths are equal to L1. However, manufacturing costs can be reduced where L1 is about half L2 as the first and second sections 202, 204 can then be identical to each other. The angles between each adjacent full side (e.g. angle between 204*c* and 204*d*, angle between 204*a*/202*a* and 202*b*, etc.) are also shown as being an equal angle a1. As the embodiment shown for the outer chamber 200 forms a generally octagonal shape, the angle a1 is about 135 degrees.

Each of the outer chamber first and second sections 202, 204 are provided with first and second side flanges that serve as a mating point for the two sections. In particular, the outer chamber first section 202 is provided with a first side flange 202*j* that extends the length of the first section 202 and is separated from adjacent planar section 202*a* by a bend line 202*l*. The outer chamber first section 202 is also provided with a second side flange 202*k* that extends the length of the first section 202 and is separated from adjacent planar section 202*e* by a bend line 202*m*. Similarly, the outer chamber second section is provided with a first side flange 204*i* that extends the length of the second section 204 and is separated from adjacent planar section 204*a* by a bend line 204*l*, and is provided with a second side flange 204*k* that extends the length of the second section 204 and is separated from adjacent planar section 204*e* by a bend line 204*m*.

Figure 8:
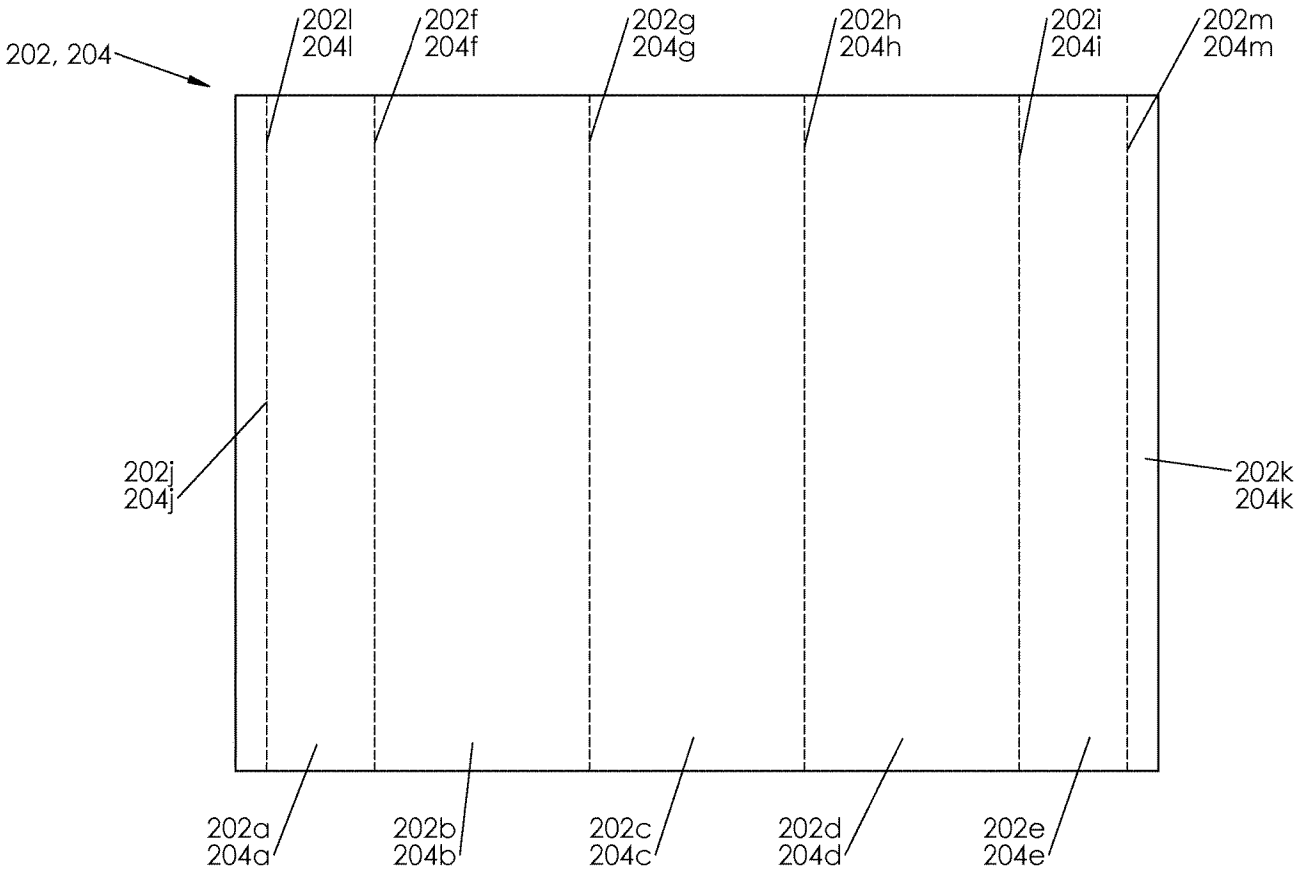
FIG. 8 is a schematic top view of an initially flat sheet of metal that can be formed into a first or second section of the outer chamber of the fan assembly shown at FIG. 1.

With reference to FIG. 8, each of the first and second outer chamber sections 202, 204 can be formed from an initially flat sheet of metal by bending the flat sheet of metal at bend lines 202*i*/204*i*, 202*f*/204*f*, 202*g*/204*g*, 202*h*/204*h*, 202*i*/204*i*, 202*l*/204*l*, and 202*m*/204*m*. In one approach, the initially flat sheet can be bent at the bend lines by a press brake machine.

As most easily seen at FIG. 7, the outer chamber 200 is formed by joining the first section 202 to the second section 204 such that the first side flanges 202*j*, 204*j* are aligned and in contact with each other and such that the second side flanges 202*k*, 204*k* are aligned and in contact with each other. Once properly aligned, the aligned side flanges can then be secured together, for example with mechanical fasteners 210. Accordingly, the aforementioned design and construction of the outer chamber 200 has the advantage of being formable through non-welding means. Alternatively, an adhesive may be used instead of mechanical fasteners for certain fan assembly sizes and applications. The first and second sections 202, 204 may also be secured by welding, for example by spot welding. However, as discussed previously, the use of certain welding processes can increase complexity and cost in manufacturing in that painting can be required and in that a metal(s) for the outer chamber 200 must be carefully chosen that is suitable for both bending and the selected welding process.

Figure 3:
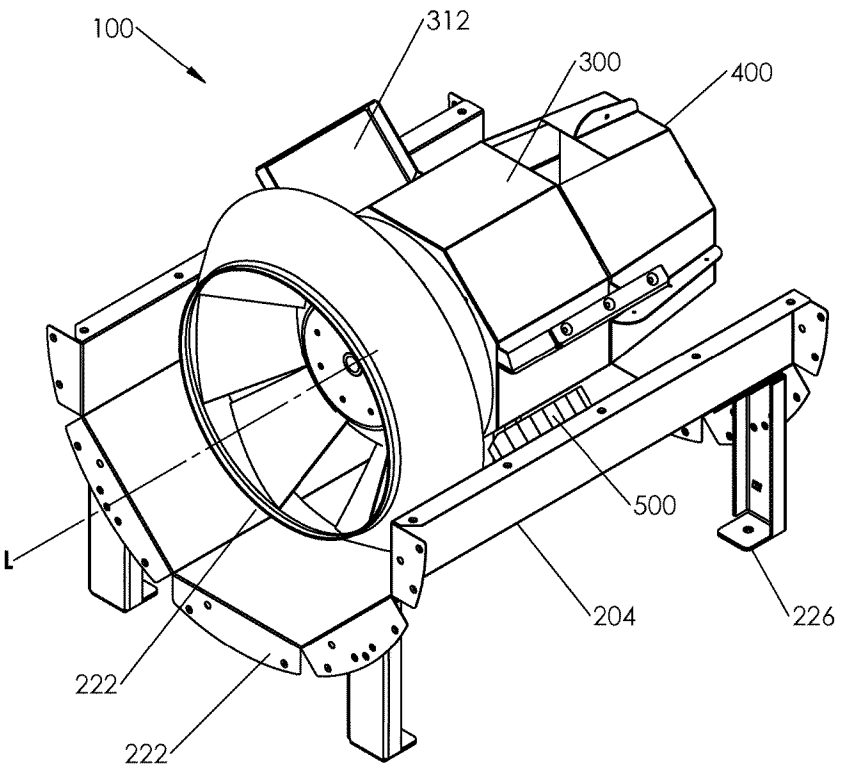
FIG. 3 is a partial cutaway front perspective view of the fan assembly shown in FIG. 1.
Figure 4:
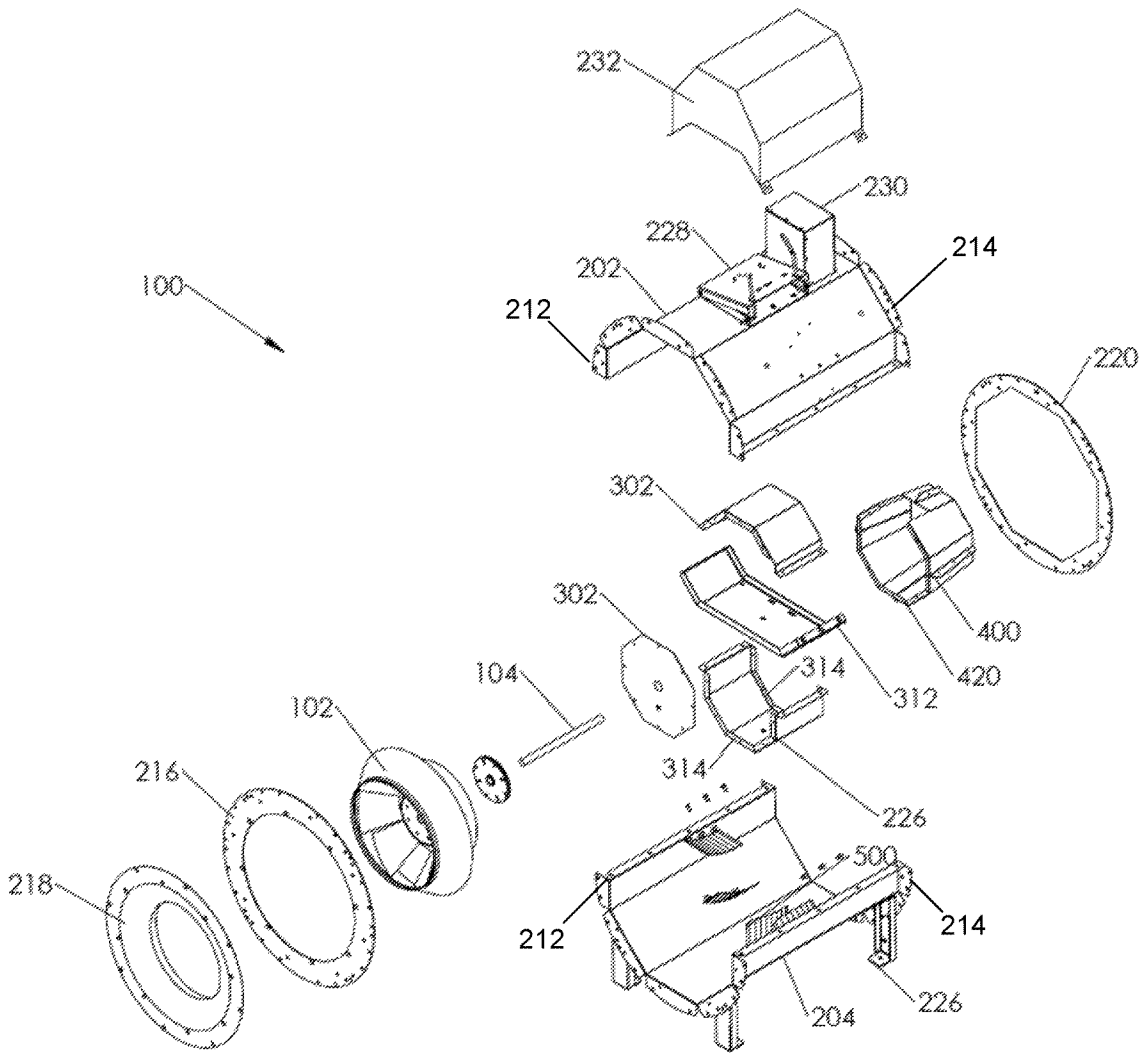
FIG. 4 is an exploded front perspective view of the fan assembly shown in FIG. 1.
Figure 5:
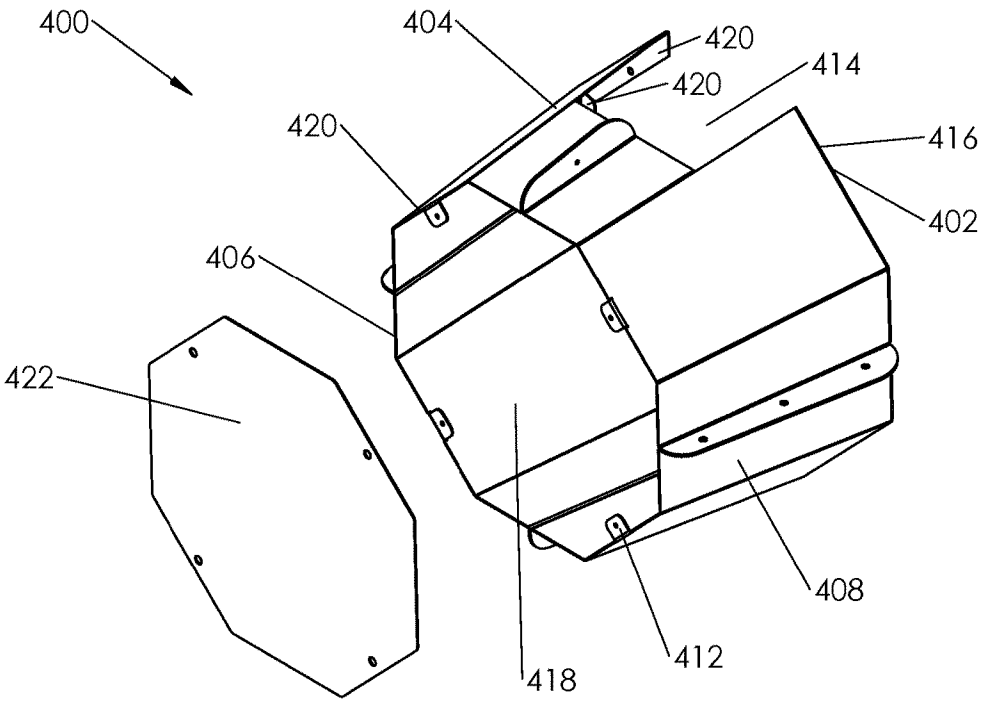
FIG. 5 is an exploded rear perspective view of a tail cone assembly of the fan assembly shown in FIG. 1.

As most easily viewed at FIGS. 3 and 4, the outer chamber 200 may be provided with a first end flange 212 adjacent the first open end and a second end flange 214 adjacent the second open end. The first end flange 212 is for providing support for a first adapter ring 216 and an inlet cone 218. The inlet cone 218 is shaped to provide a smooth pathway into the center portion of the fan rotor 102. The second end flange 214 is for providing support for a second adapter ring 220. As shown, the first and second end flanges 212, 214 are formed by a plurality of tab sections 222, each of which is shown as being formed integrally with a corresponding planar section (202*a-e*, 204*a-e*) and bent about 90 degrees with respect to the planar section (202*a-e*, 204*a-e*). Although a tab section 222 is shown at each planar section (202*a-e*, 204*a-e*), few tab sections may be provided. As shown, the adapter rings 216, 220 and the inlet cone 218 are attached to the respective tab sections 222 by mechanical fasteners 224.

Where the outer chamber 200 is to be supported from below, mounting legs 226 may be provided on the outer chamber 200 and mechanically fastened to the second section 204. Where the outer chamber 200 is to be supported from above, the outer chamber may be provided with hanger mounts configured to accept support rods and vibration isolators, where desired.

The outer chamber 200 can also be configured to support a motor plate 228 and a belt seal 230 for respectively supporting a motor 106 and housing a belt 108. Additionally, a motor cover 232 can be provided to house and protect the motor 106. As shown, each of the motor plate 228, the belt seal 230, and the motor cover 232 are mechanically fastened to the outer chamber first section 202 without the need for welding.

Fan assembly 100 also includes an inner chamber 300. The inner chamber 300 is located within the outer chamber 200 and is primarily configured for supporting the fan rotor 102 of the fan assembly and for defining an airflow path between the inner and outer chambers 300, 200. As shown, inner chamber 300 includes a first section 302 and a second section 304 that cooperatively form a tubular structure having a generally polygonal cross-sectional shape extending between a first open end 306 and a second open end 308. Although the inner chamber 300 is shown as having a generally octagonal shape with 8 planar sections, other generally polygonal shapes are possible, such as pentagonal (five sides), hexagonal (six sides), heptagonal (seven sides), decagonal (ten sides), and dodecagonal (twelve sides) shapes which progressively define cross-sectional shapes that approximate a circle. Additionally, although inner chamber 300 is shown as having two sections 302, 304, more sections may be provided.

Figure 10:
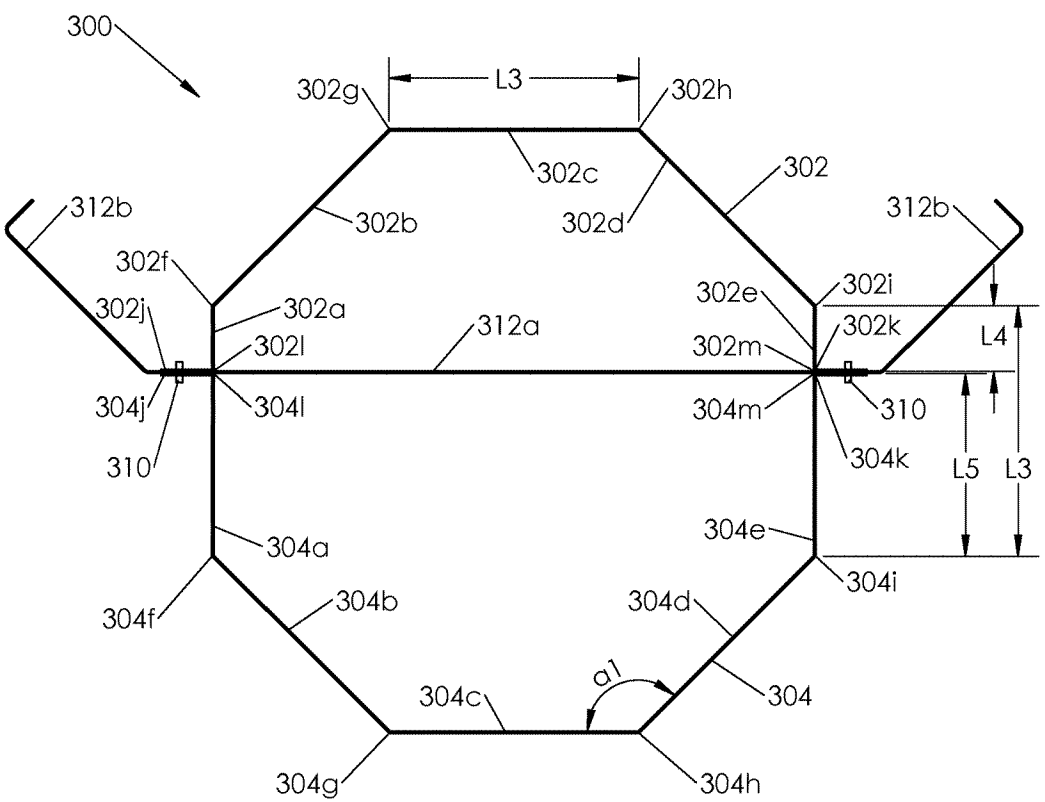
FIG. 10 is a cross-sectional view of the inner chamber and the bearing plate of the fan assembly shown in FIG. 1.
Figure 9:
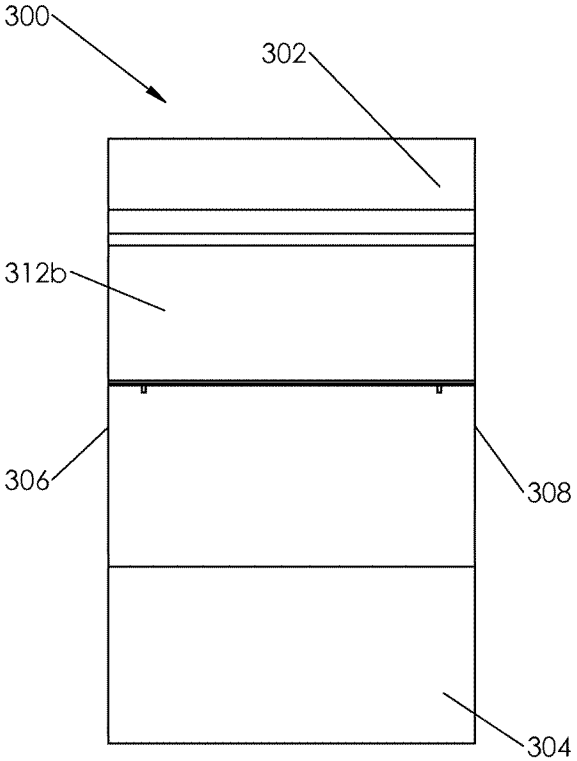
FIG. 9 is a side view of an inner chamber and the bearing plate of the fan assembly shown in FIG. 1.

In the embodiment presented in the drawings, and as most easily seen in the schematic representations shown at FIGS. 9-10, each of the first and second sections 302, 304 is provided with five planar sections separated by bend lines that together form a generally octagonal cross-sectional shape. In particular, the inner chamber first section 302 is provided with planar sections 302*a*, 302*b*, 302*c*, 302*d*, 302*e* (collectively referred to as 302*a-e*) separated by bend lines 302*f*, 302*g*, 302*h*, and 302*i* (collectively referred to as 302*f-i*). Similarly, the inner chamber second section 304 is provided with planar sections 304*a*, 304*b*, 304*c*, 304*d*, 304*e* (collectively referred to as 304*a-e*) separated by bend lines 304*f*, 304*g*, 304*h*, and 304*i* (collectively referred to as 204*f-i*). As shown, planar sections 302*b-d* and 304*b-d* each have a length L3 while planar sections 302*a* and 302*e* have a length L4 and planar sections 304*a* and 304*e* have a length L5 wherein length L4 and L5 together, in addition to the thickness of the bearing plate, generally equal length L3. This construction allows for planar sections 302*a* and 304*a* to form one of the full sides of the inner chamber 302 and for planar sections 302*e* and 304*e* to cooperatively form another one of the full sides of the inner chamber 302. It is noted that sections 302*a*/302*e* and 304*a*/304*e* could have identical lengths as is shown for the outer chamber. The angles between each adjacent full side (e.g. angle between 304*c* and 304*d*, angle between 304*a*/302*a* and 302*b*, etc.) are also shown as being an equal angle a2. As the embodiment shown for the inner chamber 300 forms a generally octagonal shape, the angle a2 is about 135 degrees.

Each of the inner chamber first and second sections 302, 304 are provided with first and second side flanges that serve as a mating point for the two sections. In particular, the inner chamber first section 302 is provided with a first side flange 302*j* that extends the length of the first section 302 and is separated from adjacent planar section 302*a* by a bend line 302*l*. The inner chamber first section 302 is also provided with a second side flange 302*k* that extends the length of the first section 302 and is separated from adjacent planar section 302*e* by a bend line 202*m*. Similarly, the inner chamber second section is provided with a first side flange 304*i* that extends the length of the second section 304 and is separated from adjacent planar section 304*a* by a bend line 304*l*, and is provided with a second side flange 304*k* that extends the length of the second section 304 and is separated from adjacent planar section 304*e* by a bend line 304*m*.

As with the outer chamber 200, each of the first and second outer chamber sections 302, 304 can be formed from an initially flat sheet of metal by bending the flat sheet of metal at bend lines 302*i*/304*i*, 302*f*/304*f*, 302*g*/304*g*, 302*h*/304*h*, 302*i*/304*i*, 302*l*/304*l*, and 302*m*/304*m*. In one approach, the initially flat sheet can be bent at the bend lines by a press brake machine.

As most easily seen at FIG. 10, the inner chamber 300 is formed by joining the first section 302 to the second section 304 such that the first side flanges 302*j*, 304*j* are aligned and in contact with the bearing plate 312 and such that the second side flanges 302*k*, 304*k* are aligned and in contact with the bearing plate 312. Once properly aligned, the aligned side flanges and bearing plate 312 can then be secured together, for example with mechanical fasteners 310. Accordingly, the aforementioned design and construction of the inner chamber 300 has the advantage of being formable through non-welding means. It is to be understood that, where a bearing plate does not extend all the way through the inner chamber, the side flanges can be directly attached to one another. It is also noted that an adhesive may be used instead of mechanical fasteners for certain fan assembly sizes and applications. The first and second sections 302, 304 may also be secured by welding, for example by spot welding. However, as discussed previously, the use of certain welding processes can increase complexity and cost in manufacturing in that painting can be required and in that a metal(s) for the inner chamber 300 must be carefully chosen that is suitable for both bending and the selected welding process.

As shown, the inner chamber 300 houses and supports a bearing plate 312 which includes planar segments separated by bend lines and which includes a perimeter flange, both of which can be formed by, for example, a brake press machine. The bearing plate 312 is configured to support bearing assemblies 112 which in turn support rotating shaft 104 to which a belt pulley/sheave 110 and a rotatable fan rotor 102 are attached. As shown, the bearing plate 312 is attached to the inner chamber 300 by mechanical fasteners 310 whereby welding is not required. For example, in the embodiment shown, a middle section 312*a* of the bearing plate 312 is mechanically fastened via fasteners 310 to the inner chamber 300 between side flanges 302*j*/304*j* and side flanges 302*k*/304*k*. Also, upwardly bent end sections 312*b* of the bearing plate 312 are secured to the planar sections 202*b*, 202*d* of the outer chamber 200 via mechanical fasteners 313. This construction allows for the bearing plate 312 to structurally secure the inner chamber 300 within the outer chamber 200.

The inner chamber 300 may also be provided with tab sections 314 on one or more of the planar sections 302*a-e*, 304*a-e* at the first and second open ends 306, 308 that may be used for connection to an end plate 302 and a tail cone assembly 400, respectively. As shown, the end plate 302 is mechanically fastened to the inner chamber 300 via the tab sections 314 and fasteners 315 so as to cover the first open end 306. In operation, the end plate 302 prevents air from flowing through the interior of the inner chamber 300 and instead directs the airflow to the interstitial space between the inner and outer chambers 200, 300. As explained herein, the tail cone assembly 400 covers the second open end 308 of the inner chamber 300.

At the second open end 308 of the inner chamber 300, a tail cone assembly 400 may be provided and secured via fasteners 315 at tab sections 314. The tail cone assembly 400 functions to cover the second open end 308 of the inner chamber and to provide an aerodynamic transition for the airflow stream passing beyond the inner chamber 300.

The tail cone assembly 400 shares many of the same features as the inner and outer chambers 300, 200 in that the tail cone assembly 400 can be formed by folding initially flat sheets of metal and joining the structures together with non-welding means to form a tubular structure. Accordingly, the various planar sections and bend lines for the tail cone assembly 400 do not need to be discussed with regard to these similar features. With regard to the similar features, the descriptions for the inner and outer chambers 200, 300 are hereby incorporated by reference into the description for the tail cone assembly 400.

The tail cone assembly 400 is different from the outer and inner chambers 200, 300 in that a polyhedral shape is formed such that the tail cone assembly 400 tapers from a first open end 416 matching the second open end 308 of the inner chamber 300 to a second open end 418. The tail cone assembly also differs in that four separate sections 402, 404, 406, 408 are joined together instead of only two sections although fewer or more sections may be utilized. In the particular embodiment shown, the sections 402-408 are each identical, thus allowing for the tail cone assembly 400 to be produced from four of the same type of piece part. This approach reduces manufacturing costs. It is noted that sections 402 and 404 are shown as being provided with notched portions 414 which may be either formed after the section piece is produced or as section pieces that are non-identical to sections 406 and 408. Although the assembled tail cone assembly 400 is shown as defining a generally octagonal shape with 8 planar sections, other generally polygonal shapes are possible, such as pentagonal (five sides), hexagonal (six sides), heptagonal (seven sides), decagonal (ten sides), and dodecagonal (twelve sides) shapes which progressively define cross-sectional shapes that approximate a circle.

Figure 11:
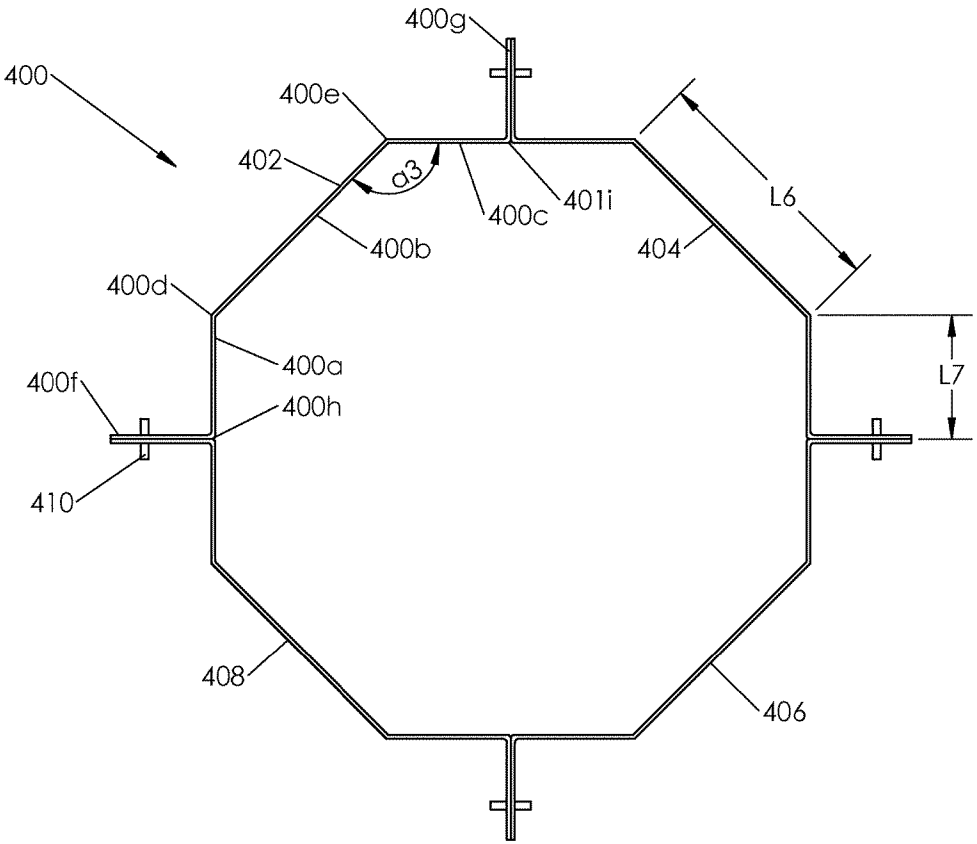
FIG. 11 is a cross-sectional view of a tail cone assembly of the fan assembly shown in FIG. 1.

In the embodiment presented in the drawings, and as most easily seen in the schematic representations shown at FIG. 11, each of the sections 402-408 is provided with three planar sections separated by bend lines that together form a generally octagonal cross-sectional shape. In particular, each section 402-408 is provided with planar sections 400*a*, 400*b*, 400*c* (collectively referred to as 400*a-c*) separated by bend lines 400*d*, 400*e* (collectively referred to as 400*d-e*). As shown, each planar section 400*b* has a length L6 while each planar section 302*a*, 302*c* has a length L7, wherein length L7 is generally one half of length L6. The angles between each adjacent side 400*a*-400*c* are also shown as being an equal angle a3. As the embodiment shown for the tail cone assembly 400 forms a generally octagonal shape, the angle a3 is about 135 degrees.

Each of the tail cone assembly sections 402-408 is provided with first and second side flanges that serve as a mating point for the adjacent sections. In particular, a first side flange 400*f* is provided that extends the length of the section and is separated from adjacent planar section 400*a* by a bend line 400*h*. Each section 402-408 is also provided with a second side flange 400*g* that extends the length of the section and is separated from adjacent planar section 400*c* by a bend line 400*i*.

As with the inner and outer chambers 200, 300, each section 402-408 can be formed from an initially flat sheet of metal by bending the flat sheet of metal at bend lines 400*h*, 400*d*, 400*e*, and 400*i*. In one approach, the initially flat sheet can be bent at the bend lines by a press brake machine.

As most easily seen at FIG. 11, the tail cone assembly is formed by joining the sections 402-408 at the respective first and second side flanges 400*f*, 400*g* such that the flanges are aligned and in contact with each other. Once properly aligned, the aligned side flanges 400*f*, 400*g* can then be secured together, for example with mechanical fasteners 410. Accordingly, the aforementioned design and construction of the tail cone assembly 400 has the advantage of being formable through non-welding means. Alternatively, an adhesive may be used instead of mechanical fasteners for certain fan assembly sizes and applications. The sections 402-408 may also be secured by welding, for example by spot welding. However, as discussed previously, the use of certain welding processes can increase complexity and cost in manufacturing in that painting can be required and in that a metal(s) for the tail cone assembly 400 must be carefully chosen that is suitable for both bending and the selected welding process.

The tail cone assembly 400 may also be provided with folded tab or flange sections 420, 412 on one or more of the planar sections 400*a-c* at the first and second open ends 416, 418 that may be used for connection to the inner chamber 300 and an end plate 422, respectively. As shown, the end plate 422 is mechanically fastened to the tail cone assembly 400 via the tab sections 422 so as to cover the second open end 418. In operation, the end plate 418 prevents air from flowing backwards through the interior of the inner chamber 300 via the tail cone assembly 400.

Figure 6A:
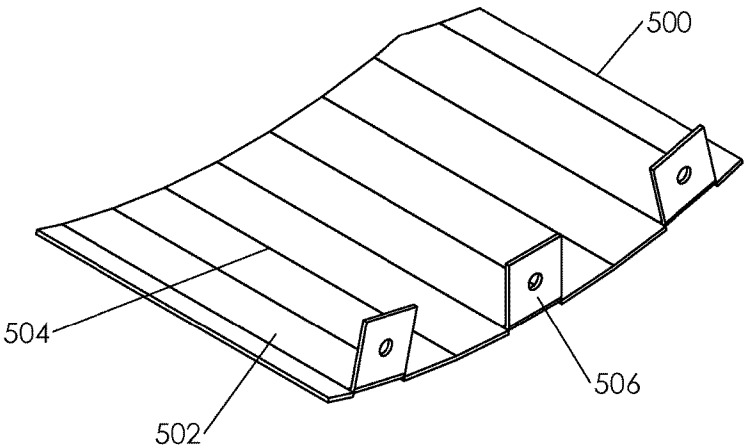
FIG. 6A is a rear perspective view of a turning vane of the fan assembly shown in FIG. 1.
Figure 6:
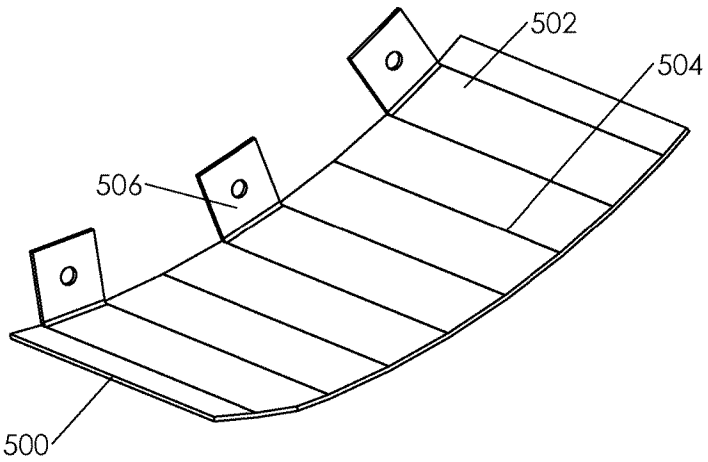
FIG. 6 is a front perspective view of a turning vane of the fan assembly shown in FIG. 1.
Figure 12:
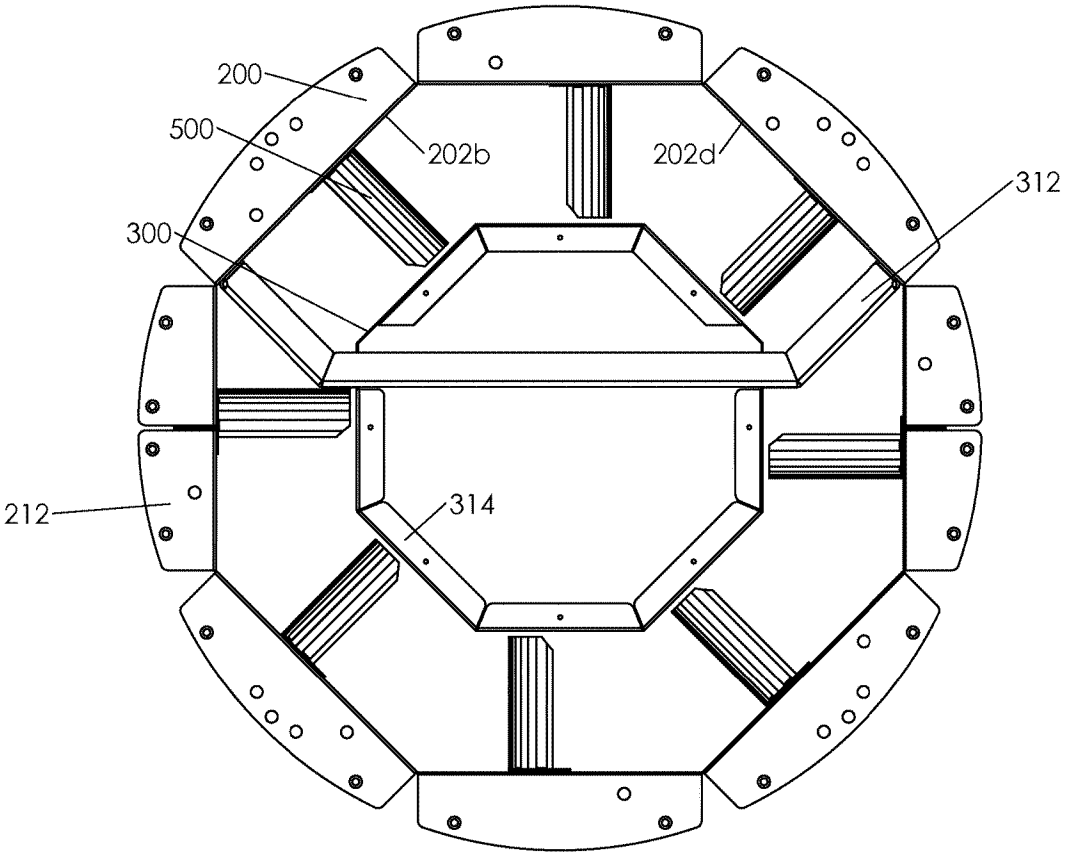
FIG. 12 is an end view showing selected elements of the fan assembly shown in FIG. 1.
Figure 13:
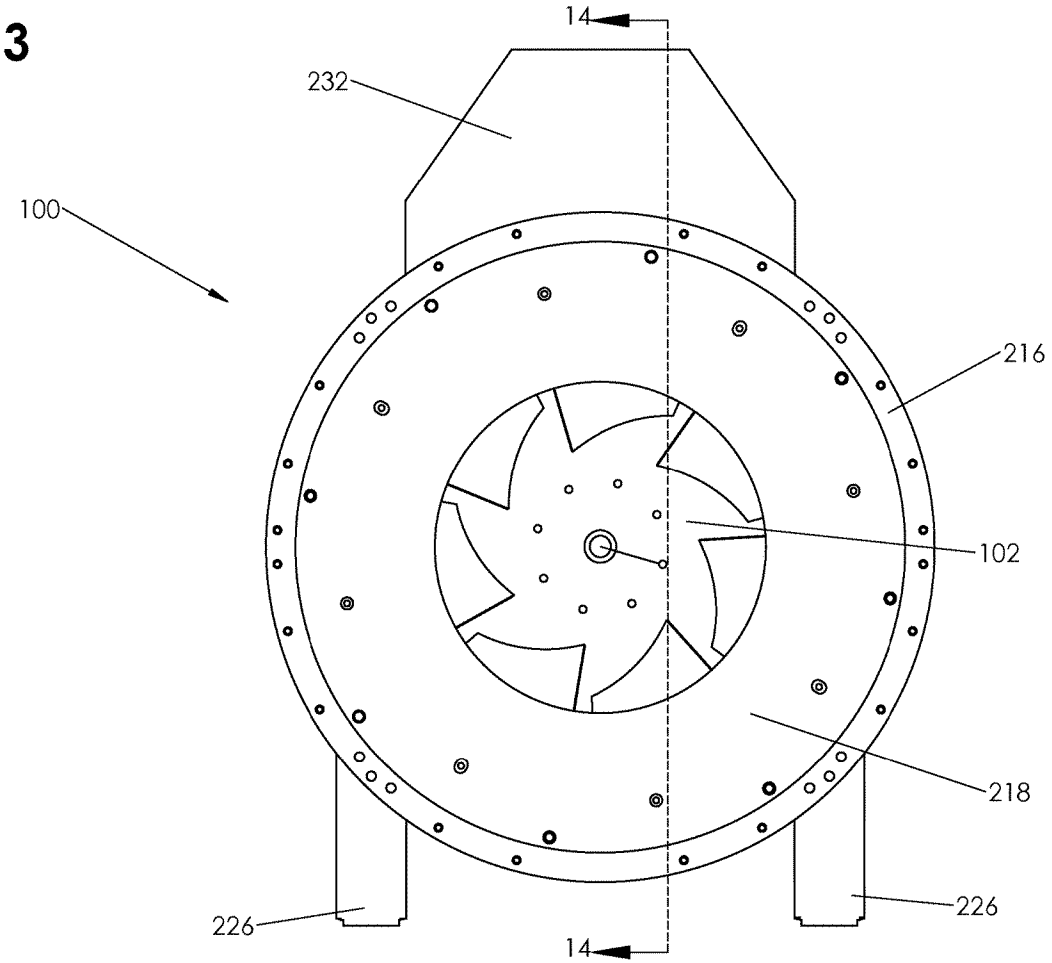
FIG. 13 is an end view of the fan assembly shown in FIG. 1.
Figure 14:
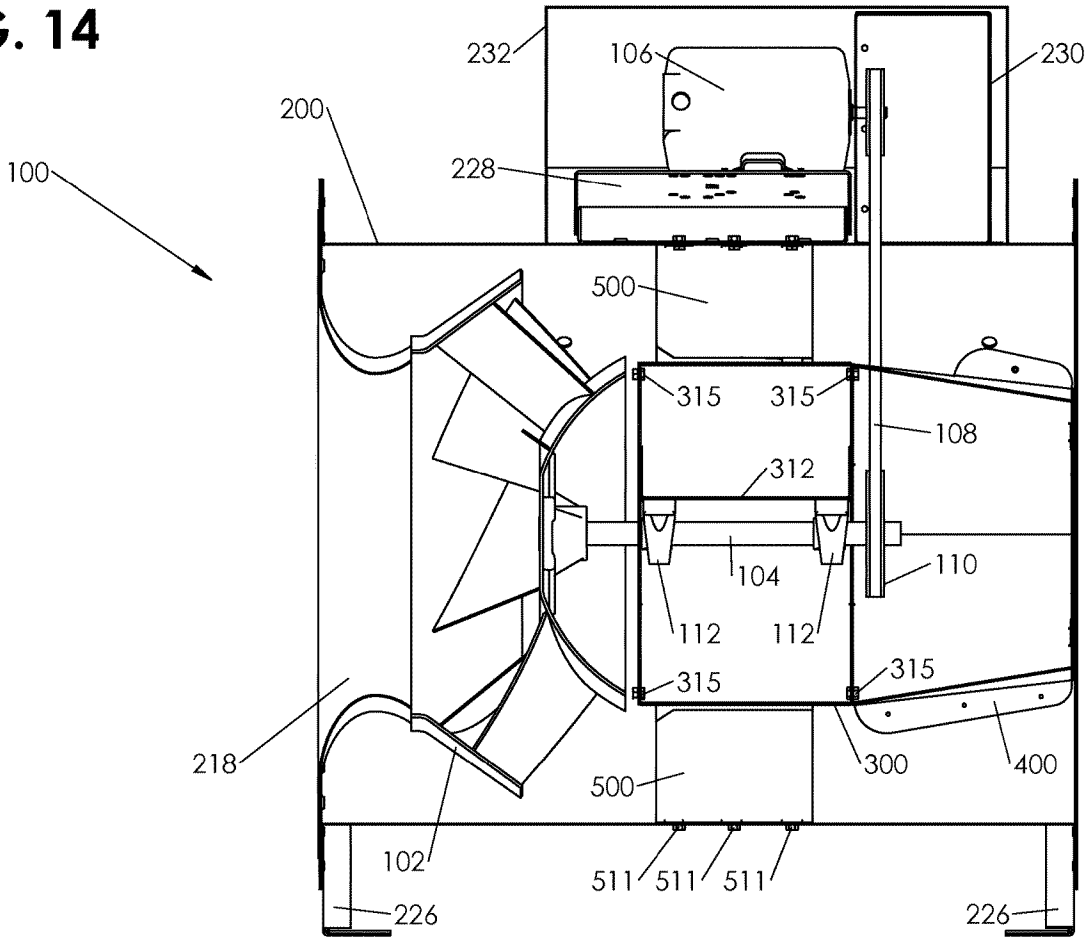
FIG. 14 is a cross-sectional view of the fan assembly shown in FIG. 13, taken along the line 14-14.

With reference to FIGS. 6 and 12, additional detail regarding the turning vanes 500 can be seen. As configured, each of the turning vanes 500 is configured with a plurality of planar sections 502 separated by bend lines 504. Additionally, tabs 506 may be provided along the sides of the turning vanes 500 to facilitate mounting of the turning vane 500. In one embodiment, each of the turning vanes can be formed from an initially flat sheet of metal by bending the flat sheet of metal at bend lines 504. In one approach, the initially flat sheet can be bent at the bend lines 504 by a press brake machine. Once formed, the turning vanes 500 can be mounted to one or both of the inner chamber 300 and the outer chamber 200. As shown, the turning vanes 500 are secured to the outer chamber 200 via fasteners 511 and spaced away from the inner chamber 300. However, it is to be understood that the turning vanes could be secured to the inner chamber 300 and be spaced from the outer chamber, or be secured to both the inner and outer chambers 200, 300 to structurally secure the inner chamber 300 to the outer chamber 200. With reference to FIG. 12, it can be seen that a turning vane 500 extends from each of the full sides of the inner chamber 300 to a corresponding parallel full side of the outer chamber 200 such that each turning vane 500 is perpendicular to the full sides of the chambers 200, 300 to which it is attached. As mentioned previously, the turning vanes 500 also function to straighten airflow leaving the rotatable fan assembly 100.

What is claimed is:

1. A fan assembly comprising:

an outer chamber having a first plurality of adjoining planar sidewall segments, wherein each planar sidewall segment forms an obtuse angle with the adjoining planar sidewall segments to form a tubular structure with a polygonal cross-sectional shape having at least five sides, the outer chamber defining a longitudinal axis extending between a first open end and an opposite second open end;

an inner chamber having a second plurality of planar sidewall segments that together form a tubular structure with a cross-sectional polygonal shape, the inner chamber being disposed within the outer chamber and defining a longitudinal axis, wherein the inner chamber and the outer chamber each include a first section and a second section mechanically fastened to the first section;

a plurality of turning vanes located between the inner chamber and the outer chamber;

a rotatable fan assembly disposed within the outer chamber, the rotatable fan assembly being configured to move an airflow stream through the outer chamber from the first open end to the second open end; and a tail cone assembly having at least five planar sidewall segments that together form a tapered tubular structure with a polygonal cross-sectional shape with a first open end and a second open end, the tail cone first open end being mounted to the second open end of the inner chamber.

2. The fan assembly of claim 1, wherein the number of planar sidewall segments of the second plurality of planar sidewall segments is equal to the number of planar sidewall segments of the first plurality of planar sidewall segments.

3. The fan assembly of claim 2, wherein the first and second plurality of planar sidewall segments each include eight planar sidewall segments to form an octagonal cross-sectional shape.

4. The fan assembly of claim 1, wherein the first sections and the second sections of the inner chamber and the outer chamber each define an equal number of planar sidewall segments.

5. The fan assembly of claim 4, wherein the first sections and the second sections of the inner and outer chamber each have at least three planar sidewall segments.

6. The fan assembly of claim 1, wherein the inner chamber and the outer chamber first and second sections each have a first side flange and a second side flange, wherein:

the first side flanges of the inner chamber first and second sections are secured together by mechanical fasteners;

the second side flanges of the inner chamber first and second sections are secured together by mechanical fasteners;

the first side flanges of the outer chamber first and second sections are secured together by mechanical fasteners; and the second side flanges of the outer chamber first and second sections are secured together by non-welding means.

7. The fan assembly of claim 1, wherein each turning vane extends between an inner chamber planar sidewall segment and an outer planar sidewall segment that are parallel to each other.

8. The fan assembly of claim 1, wherein each turning vane has a main body including a plurality of planar segments separated by bend lines.

9. The fan assembly of claim 1, wherein a turning vane extends between each inner chamber planar sidewall segment to a corresponding outer chamber planar sidewall segment, wherein each turning vane is connected to only one of the inner chamber and the outer chamber.

10. The fan assembly of claim 1, wherein each turning vane is secured to the outer chamber or the inner chamber with mechanical fasteners.

11. The fan assembly of claim 1, further comprising:

a bearing plate supporting the fan assembly, the bearing plate being formed from a plurality of planar sidewall sections and being mounted to the inner chamber and the outer chamber.

12. The fan assembly of claim 11, wherein the bearing plate is secured to the inner and outer chambers by non-welding means.

13. The fan assembly of claim 1, further comprising:

an end plate mounted to an end of the inner chamber, the end plate covering the first open end of the inner chamber.

14. The fan assembly of claim 1, wherein the tail cone assembly has eight planar sidewall segments to form an octagonal cross-sectional shape.

15. The fan assembly of claim 1, wherein the tail cone assembly includes a first section and a second section mechanically fastened to the first section.

16. The fan assembly of claim 15, wherein the first section and the second section have an equal number of planar sidewall segments.

17. The fan assembly of claim 16, wherein the first section and the second section each have at least three planar sidewall segments.

18. The fan assembly of claim 15, wherein the tail cone assembly first and second sections each have a first side flange and a second side flange, and wherein the first side flanges of the first and second sections are secured together by mechanical fasteners, and wherein the second side flanges of the first and second sections are secured together by non-welding means.

19. The fan assembly of claim 18, further comprising:

an end plate mounted to and covering the second open end of the tail cone assembly.

20. The fan assembly of claim 19, wherein the end plate is mounted to the tail cone assembly with mechanical fasteners.

* * * * *